United States Patent [19]

De Roo et al.

[11] 3,980,575

[45] Sept. 14, 1976

[54] ELECTROPHOTOGRAPHIC TONER COMPOSITION

[75] Inventors: Pierre Richard De Roo, Wilrijk; Jozef Leonard Van Engeland, St. Katelijne-Waver; Gaston Eduard Van der Auweraer, Mechelen, all of Belgium

[73] Assignee: AFGA-GEVAERT N.V., Mortsel, Belgium

[22] Filed: May 10, 1973

[21] Appl. No.: 358,913

[30] Foreign Application Priority Data

May 22, 1972 United Kingdom ..... 24030/72

[52] U.S. Cl. ..... 252/62.1 P

[51] Int. Cl.[2] ..... G03G 9/00

[58] Field of Search ..... 252/62.1 P

[56] References Cited

UNITED STATES PATENTS

| | | | |
|---|---|---|---|
| 3,672,928 | 6/1972 | Madrid et al. | 252/62.1 P X |
| 3,681,107 | 8/1972 | Moriconi et al. | 252/62.1 P X |
| 3,723,114 | 3/1973 | Hagenbach et al. | 252/62.1 P X |

*Primary Examiner*—Samuel W. Engle
*Assistant Examiner*—Peter A. Nelson
*Attorney, Agent, or Firm*—A. W. Breiner

[57] ABSTRACT

A toner material for use in the development of electrostatic charge patterns is described which comprises carbon black as coloring material, polystyrene as thermoplastic resin binder and at least one diester of orthophthalic or metaphthalic acid that is solid at room temperature as plasticizer, wherein the polystyrene binder has a molecular weight comprised between about 30,000 and about 70,000, the proportion by weight of the carbon black to the binder is comprised between about 5:100 and about 20:100, and the proportion by weight of the said plasticizer(s) to the binder is comprised between about 2:100 and about 15:100. The toner material is of a very simple and inexpensive composition and nevertheless has optimum photographic and physical properties.

11 Claims, No Drawings

ELECTROPHOTOGRAPHIC TONER COMPOSITION

The present invention relates to electrophotography, and more particularly to improvements in the development of electrostatic images and to developers used therefor.

Known electrophotographic processes for producing visible images comprise the steps of electrostatically charging in the dark a photoconductive surface of an inorganic photoconductor e.g. zinc oxide and selenium or of an organic photoconductor, image-wise exposing the said surface to form a latent electrostatic image and developing the material to form a visible image by depositing on the image a finely divided electroscopic material usually a resin, which may be coloured and is known as "toner". Depending on the sign of the electrostatic charge the toner particles are attracted and deposited on the charged areas of the latent image or are repelled by the charged areas and deposited on the discharged areas. The toner image is then fixed by heating, by an overcoating treatment or by the action of solvents. Before fixing, the toner image may be transferred to a support surface such as paper and then permanently affixed thereto. Instead of forming the latent electrostatic image by the steps described above it is also possible to directly charge a layer in image configuration.

For a better control of the development of the latent image the toner is used in combination with solid carrier particles or the toner particles can be dispersed in an insulating liquid.

If a dry developer is used, it is composed of two components, a finely ground pigmented or coloured resinous toner and a relatively coarse-grained carrier material. For the development of the latent image, the developing mixture may be cascaded merely over the exposed plate. The carrier material, e.g., glass or steel beads, which may be enveloped by a resinous film-forming product, carries the toner as it cascades over the plate and also triboelectrically charges the toner particles to the desired polarity. As the toner-carrier mixture flows over the latent electrostatic image bearing surface the toner particles are attracted by the charged areas of the image and not by the discharged areas or background areas of the image. Most of the toner particles accidentally deposited on the background areas of the image, are taken away by the rolling carrier particles due to the greater electrostatic attraction between the toner and the carrier than between the toner and the discharged background. The powder image formed is then fixed as described above on the photoconductive plate or can be transferred to a receptor surface, e.g. a paper sheet. The transfer can be accomplished by bringing the powder image in contact with the receptor surface, if necessary, in the presence of an electrostatic field. If the receptor surface, e.g. the paper sheet, is then stripped from the image-carrying surface, it carries with it a substantial amount of toner particles in the form of the desired image. Subsequently, this image can be made permanent, i.e. fixed, according to any desired method such as heating or solvent fixing.

The photographic and physical properties of the toner should be as favourable as possible. The selection of the binding agent used in the toner material is determined especially by its triboelectrical properties. Indeed, the binding agent should allow the toner to obtain a sign of charge opposite to that of the sign of the photoconductor and of the carrier. The choice of the binding agent is also determined by physical properties. The melting point should be chosen so that the properties of the toner are not altered at normal working temperatures. On the other hand the toner should be capable of being fixed by heat, whereas the paper to which the toner image has been transferred should not be scorched thereby. The brittleness of the toner should be low also. Indeed too high a brittleness would result in the soiling of the selenium drum, thus causing image fog and soiling of the apparatus in consequence of dust formation.

The toner should further have appropriate plasticity characteristics. In the development zone the toner particles collide continuously. These collisions should not give rise to a change in the triboelectrical and physical properties of the toner. This can only be accomplished if a sufficient elastic toner is composed, i.e. a toner which by the influence of pressure undergoes a certain deformation, but which immediately upon elimination of the cause assumes its original condition again.

Many of the known toner-carrier mixtures for the development of electrostatic images are deficient in one or other respect. For example, some toner materials, though possessing proper triboelectric properties, give rise to the formation of dust, which is difficult to remove from reusable imaging surfaces, e.g. selenium drums, and which also deposite on critical machine parts, e.g., optical lenses. Other toner materials are not rapidly fused so that the powder images are difficult to fix by heating without scorching the paper. Toner materials that are easily fused by heating sometimes tend to cake or agglomerate during handling and storage and tend to form tacky images. Other toner materials are deficient photographically in that the density of the images is not high enough and the degree of image definition is low.

Moreover, in order to meet the requirements as regards the physical and photographic properties the toner materials are often of a complex and expensive composition.

It is apparent from the above that there is a continuing need for improved toners and developers.

In accordance with the present invention, a toner material suitable for use in the development of electrostatic images is provided, which is of a very simple and inexpensive composition and nevertheless has optimum photographic and physical properties.

The electrophotographic toner material according to the present invention incorporates particles comprising carbon black as colouring material, polystyrene having a molecular weight comprised between about 30,000 and about 70,000 as thermoplastic resin binder, and at least one diester of orthophthalic or metaphthalic acid that is solid at room temperature as plasticizer, wherein the proportion by weight of the carbon black to the binder is comprised between about 5:100 and about 20:100, preferably between about 8:100 and about 15:100 and the proportion by weight of the said plasticizer(s) to the binder is comprised between about 2:100 and about 15:100, preferably between about 2:100 and about 8:100.

The invention also provides developing material for use in the development of electrostatic images, which material comprises toner particles and carrier particles, the said toner particles comprising carbon black, polystyrene of a molecular weight comprised between about 30,000 and 70,000 and at least one solid diester of orthophthalic or metaphthalic acid in the proportions given above.

The plasticizer used is preferably dimethyl isophthalate though other solid esters of ortho- or metaphthalic acid may be used e.g. diphenyl phthalate, dihexyl phthalate, dicyclohexyl phthalate and diethoxyethyl phthalate.

For the preparation of the toner, the starting materials are preferably mixed in pulverised state and then ground very finely in a ball mill. The mixture is then heated to melting and the melt is very thoroughly mixed so that the carbon black is completely incorporated in the resin. The melt is cooled and the toner substance thus obtained is crushed and further ground to the desired particle size, preferably less than 50 $\mu$m, e.g. between 1 and 30 $\mu$m.

In the preparation of a toner-carrier developing mixture according to the present invention, the carrier and toner are preferably mixed in a rate comprised between 100 to 0.1 and 100 to 20, preferably between 100 to 0.5 and 100 to 10.

It is suitable to use carriers having an average grain size between 100 and 1000 $\mu$m, although smaller or larger carrier particles may be used.

As is well known in the art, the carrier particles can be iron filings, glass balls, silicon dioxide particles, granular zircon, polymethyl methacrylate particles, crystals of inorganic salts for example ammonium chloride, sodium chloride, sodium nitrate, aluminium nitrate, potassium chloride, etc. The carriers may be used with or without a coating, which imparts the necessary triboelectric properties to the granular carrier material. It is preferred to use as carrier material glass balls or iron beads.

When the carrier particles used in combination with the electrostatic toner material according to the invention are formed by glass beads, the beads may be subjected to a special pretreatment. According to this pretreatment degreased glass beads are treated with a trialkoxysilane or with an organic phosphorus compound and enveloped with a layer of ethylcellulose. Such a pretreatment of carrier glass beads has been described in the complete specifications filed in connection with the Belgian Patent Specifications No. 777,294 filed Dec. 27, 1971 and No. 777,353 filed Dec. 28, 1971 both by Agfa-Gevaert N.V.

The toner-carrier developing mixture according to the present invention may incorporate compounds that promote the free flowing characteristics of the toner particles, improve image contrast and solid area coverage as well as the surface smoothness and/or facilitate cleaning of the imaging surface between use and re-use. These compounds may be incorporated into the developing mixture in any suitable way. They can be added to the toner-carrier mixture or to the toner in the form of loose powder or they can be melted together with toner components during the formation of the toner particles. Examples of such compounds are solid hydrophobic metal salts of a fatty acid e.g. zinc stearate as described in British Patent No. 1,172,839 filed Nov. 29, 1966 by Rank-Xerox Ltd. and solid hydrophobic bivalent or trivalent metal salts of a half-ester of a straight-chain or branched-chain aliphatic dicarboxylic acid or solid hydrophobic bivalent or trivalent metal salts of a monoester or diester of a phosphorus oxyacid e.g. zinc octadecyl succinate and zinc monoisohexadecyl phosphate as described in Belgian Patent No. 783,766 filed May 19, 1972 by Agfa-Gevaert N.V. (corresponding with co-pending British Patent Application No. 16345/71).

In addition to the solid diester of ortho- or metaphthalic acid as plasticizer the toner may further comprise other plasticizers well known in the art of electrophotographic toner preparation.

For the development of the electrostatic images the toner is applied loosely to the latent electrostatic image where it is attracted electrostatically at the latent image areas. The most usual developing method is cascade development. According to this method the electrostatic toner is mixed with a granular carrier as referred to above, which may be electrically conductive or insulating.

The carrier particles, when brought in close contact with the powdery toner particles, obtain a charge of a polarity opposed to that of the toner particles, so that the latter envelop the carrier particles. If a positive reproduction of an electrostatic image is desired, the carrier is chosen in such a way that the toner particles obtain a charge with a polarity opposite to that of the electrostatic image. In order to obtain a negative copy the carrier can be chosen in such a way that the toner particles obtain a charge having the same polarity as that of the electrostatic image.

The toner particles are attracted either by the charged or discharged areas of the surface and separated from the carrier particles, which in consequence of gravity continue their rolling motion.

The toner particles are fixed on paper or any other support by heat or solvent fixing. When heat energy is supplied or solvent is added to the toner, the toner softens, tends to become more fluid, flows together and is attached irreversibly to the paper support.

The following examples illustrate the present invention.

EXAMPLE 1

A toner mixture was prepared from 8.65 parts by weight of polystyrene having a molecular weight of approximately 30,000–40,000, 1 part by weight of Spezialschwarz IV (trade name for carbon black sold by Deutsche Gold- und Silberscheideanstalt, Frankfurt a/M, Germany) and 0.35 part by weight of dimethyl isophthalate.

The components were mixed in dry condition and then melted at a temperature of 110°–130°C. The melt was then kneaded for approximately 30 min while keeping the temperature at about 80°C. Thereupon the melt was cooled to approximately 40°C and crushed to a particle size of approximately 1 mm. The powder was ground in aqueous medium in a vibration ball mill for 15 h. After drying and sieving, a free-flowing toner having a particle size from 5 to 20 $\mu$m with a fixing temperature of approximatively 105°C was obtained.

A developer mixture was then prepared by mixing 1 g of these toner particles with 100 g of carrier particles composed of glass beads having a diameter of 600 to 800 $\mu$m After positively charging of a selenium drum and image-wise exposing to an original, the developing mixture was cascaded over the electrostatic latent image. A black toner image was left on the selenium drum. The image was then transferred to a paper support and fixed thereon by heating.

In this way a non-tacky sharp image with sufficiently high density was obtained. After successive developments with the same developer mixture only a very weak change in contrast was observed.

EXAMPLE 2

Example 1 was repeated with the only difference that in the preparation of the toner mixture 8.50 parts by weight of the said polystyrene and 0.50 part by weight of diphenyl phthalate were added.

The same favourable results as described in example 1 were attained.

We claim:

1. A toner material for use in the development of electrostatic charge patterns consisting essentially of carbon black as a colouring material, polystyrene as a thermoplastic resin binder and at least one diester of orthophthalic or metaphthalic acid that is solid at room temperature as a plasticizer, wherein said polystyrene binder has a molecular weight ranging from about 30,000 and about 70,000, the proportion by weight of the carbon black to the binder is from about 5:100 and about 20:100, and the proportion by weight of said plasticizer to said binder is from about 2:100 and about 15:100.

2. A toner material according to claim 1, wherein the proportion by weight of the said plasticizer to the binder is from about 2:100 and about 8:100.

3. A toner material according to claim 1, wherein said plasticizer is dimethyl isophthalate.

4. A toner material according to claim 1, wherein the polystyrene binder has a molecular weight of approximately 30,000 –40,000.

5. A developing material for use in electrophotographic processes which material consists essentially of finely divided toner particles and carrier particles, said toner particles being of a material comprising carbon black as a colouring material, polystyrene as a thermoplastic resin binder and at least one diester of orthophthalic or metaphthalic acid that is solid at room temperature as a plasticizer, wherein said polystyrene binder has a molecular weight ranging from about 30,000 and about 70,000, the proportion by weight of the carbon black to the binder being from about 5:100 and about 20:100, and the proportion by weight of the said plasticizer to said binder being from about 2:100 and about 15:100.

6. A developing material according to claim 5, wherein the proportion by weight of the said plasticizer to the binder is from about 2:100 and about 8:100.

7. A developing material according to claim 5, wherein said plasticizer is dimethyl isophthalate.

8. A developing material according to claim 5, wherein said polystyrene has a molecular weight of from about 30,000 –40,000.

9. A developing material according to claim 5, wherein the said toner particles have a particle size of less than 50 $\mu$m.

10. A developing material according to claim 5, wherein the ratio of carrier to toner is from about 100 to 0.1 and 100 to 20.

11. A developing material according to claim 5, wherein the carrier particles are glass balls or iron beads.

* * * * *